US011020625B1

(12) United States Patent
Castle

(10) Patent No.: US 11,020,625 B1
(45) Date of Patent: Jun. 1, 2021

(54) MULTIMODAL FITNESS BAR

(71) Applicant: Castle Fit LLC, Atlanta, GA (US)

(72) Inventor: Daniel Castle, Atlanta, GA (US)

( * ) Notice: Subject to any disclaimer, the term of this patent is extended or adjusted under 35 U.S.C. 154(b) by 0 days.

(21) Appl. No.: 17/082,451

(22) Filed: Oct. 28, 2020

(51) Int. Cl.
*A63B 21/04* (2006.01)
*A63B 21/055* (2006.01)
*A63B 21/00* (2006.01)

(52) U.S. Cl.
CPC ..... *A63B 21/0442* (2013.01); *A63B 21/0555* (2013.01); *A63B 21/4015* (2015.10); *A63B 21/4035* (2015.10)

(58) Field of Classification Search
CPC ..... A63B 21/0442; A63B 21/0555; A63B 21/4015; A63B 21/4035; A63B 21/02; A63B 21/04; A63B 21/055–0557; A63B 21/40–4001; A63B 21/4011–4015; A63B 21/4027–4035
See application file for complete search history.

(56) References Cited

U.S. PATENT DOCUMENTS 5,125,649 A * 6/1992 Fuller ..... A63B 21/0004 482/106
5,830,110 A * 11/1998 Fielding ..... A63B 21/00043 482/44
5,860,897 A * 1/1999 Gilbert ..... A63B 21/055 482/123
6,648,804 B2 * 11/2003 Chen ..... A63B 21/0004 482/125
7,090,627 B1 * 8/2006 Walker ..... A63B 21/055 482/121
7,326,157 B2 * 2/2008 Wu ..... A63B 21/0004 482/121
7,387,599 B1 * 6/2008 Hsu ..... A61H 15/0092 482/122
7,743,656 B1 * 6/2010 Dickinson ..... A63B 21/0552 73/379.01
7,922,634 B1 * 4/2011 Wu ..... A63B 23/03525 482/126
9,254,405 B1 * 2/2016 Marji ..... A63B 21/02
9,775,764 B1 * 10/2017 Rill ..... A61H 1/0237
D902,330 S * 11/2020 Jaquish ..... A63B 21/0004 D21/673
2005/0239617 A1 * 10/2005 Tenaglia ..... A63B 21/00043 482/122
2007/0287614 A1 * 12/2007 Fuller ..... A63B 21/169 482/121
2008/0132392 A1 * 6/2008 Moulton ..... A63B 23/035 482/122
2009/0137371 A1 * 5/2009 Fuller ..... A63B 23/1281 482/122
2009/0192022 A1 * 7/2009 Kulka ..... A63B 21/153 482/46
2009/0275449 A1 * 11/2009 Terry ..... A63B 23/03525 482/139
2014/0113779 A1 * 4/2014 Loach ..... A63B 21/0053 482/115

* cited by examiner

*Primary Examiner* — Andrew S Lo
(74) *Attorney, Agent, or Firm* — David M Peer

(57) ABSTRACT

A multimodal fitness bar with a bar assembly and resistance assembly is disclosed. Exemplary implementations may further include a hanging member, a weighting assembly, a toggle assembly, a furling member, and/or other components. The resistance assembly may include a flexible fabric sheet with an opening configured to receive a user's foot and the bar assembly may include handles configured to be gripped by a user.

18 Claims, 5 Drawing Sheets

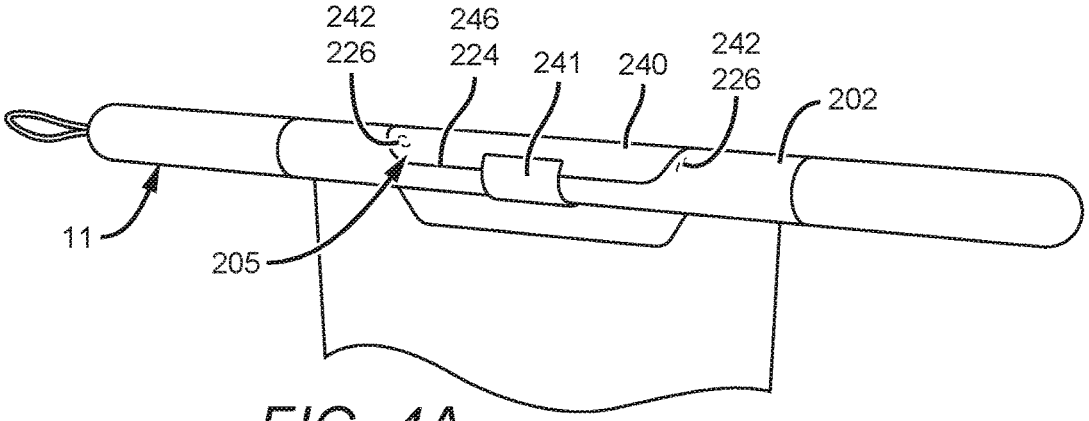
FIG. 4A
FIG. 4B
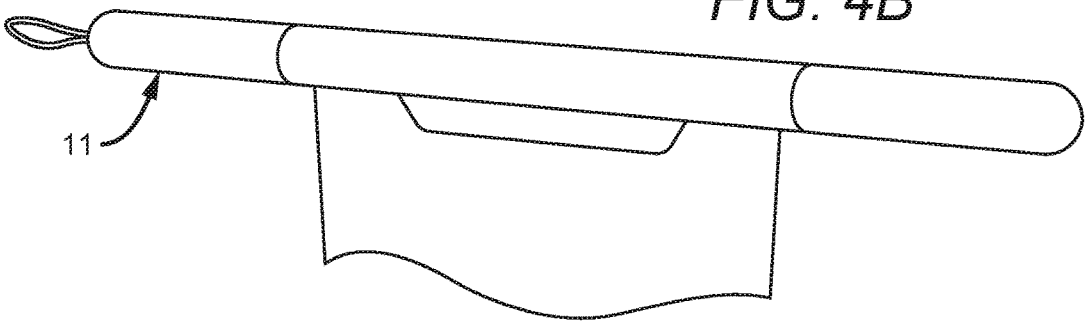
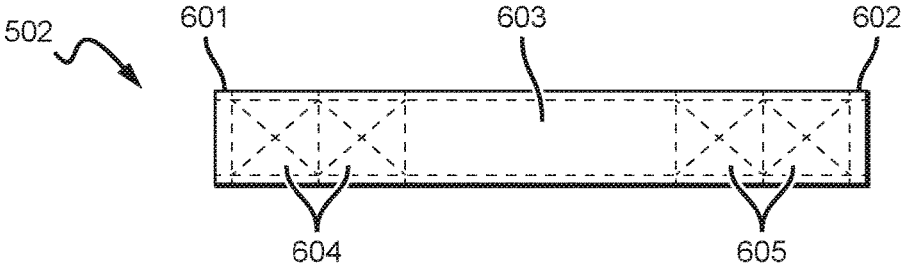
FIG. 6
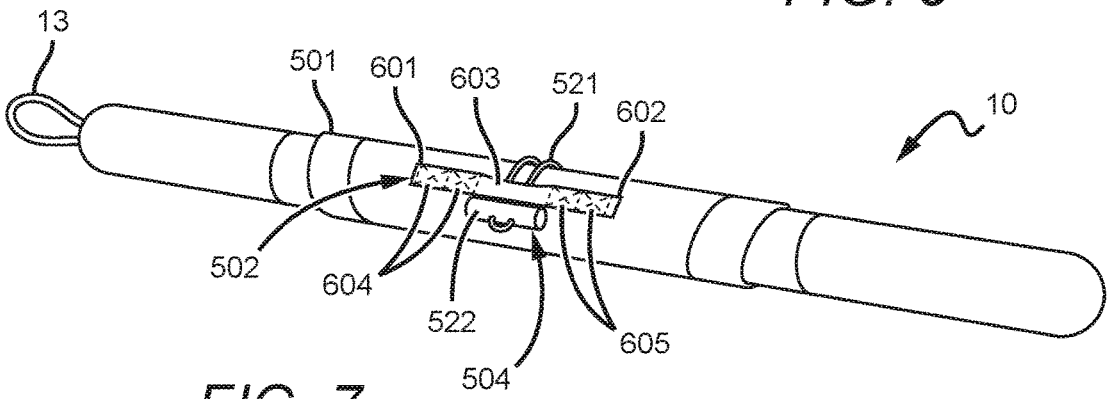
FIG. 7

MULTIMODAL FITNESS BAR

FIELD OF THE DISCLOSURE

The present disclosure relates to a multimodal fitness bar.

BACKGROUND OF THE INVENTION

Fitness bars are known. Resistance bands are known.

BRIEF SUMMARY OF THE INVENTION

One aspect of the disclosure relates to a multimodal fitness bar with a resistance assembly. In some implementations the multimodal fitness bar may include a bar assembly, which may further include a weighting assembly. The weighting assembly may allow a user to adjust the weight of the multimodal fitness bar. A resistance assembly may be attached to the bar assembly. The resistance assembly may be configured to furl about the bar assembly to reduce the footprint of the multimodal fitness bar when the resistance assembly is not in use.

In some implementations, the bar assembly may be configured to be held in the hands of a user. A distal portion of the resistance assembly may include a loop for receiving the user's foot. When in an unfurled configuration, the user may create resistance between the user's hands and the user's foot by pressing the user's foot away from the user's hands. Such resistance allows a user to perform a variety of exercises and stretches including, but not limited to: resistance squats, resistance lunges, resistance bicep curls, resistance rows, resistance shoulder press, resistance deadlifts, resistance rows, calf stretches, hamstring stretches, and gluteus stretches. When in a furled configuration, a user may perform a variety of exercises and stretches including, but not limited to: weighted squats, weighted lunges, weighted bicep curls, weighted deadlifts, weighted rows, weighted shoulder press, weighted one handed lateral raises, and overhead triceps extensions.

A multimodal fitness bar, in accordance with one or more implementations herein, presents advantages over the fitness bars and fitness bands known in the art including, but not limited to: allowing a user to perform myriad exercises and stretches with a single device; a relatively compact form factor, and a secured furled configuration that substantially reduces the form factor of the device.

These and other objects, features, and characteristics of the apparatus and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification in the claims, the singular form of "a", "an", and "the" include plural references unless the context clearly dictates otherwise.

BRIEF DESCRIPTION OF THE DRAWINGS

FIG. 4A is a partial, front perspective view of a multimodal fitness bar, in accordance with one or more implementations.

FIG. 4B is a partial, front perspective view of a multimodal fitness bar, in accordance with one or more implementations.

FIG. 6 is a front view of a front furling member, in accordance with one or more implementations.

FIG. 7 is a front perspective view of a multimodal fitness bar in a furled configuration, in accordance with one or more implementations.

DETAILED DESCRIPTION OF THE INVENTION

Various implementations and aspects of the disclosure will be described with references to details discussed below, and the accompanying drawings will illustrate the various implementations. The following description and drawings are illustrative of the disclosure and are not to be construed as limiting the disclosure. Numerous specific details are described to provide a thorough understanding of various implementations of the present disclosure. However, in certain instances, well-known or conventional details are not described in order to provide a concise discussion of implementations of the present disclosure.

Figure 1:
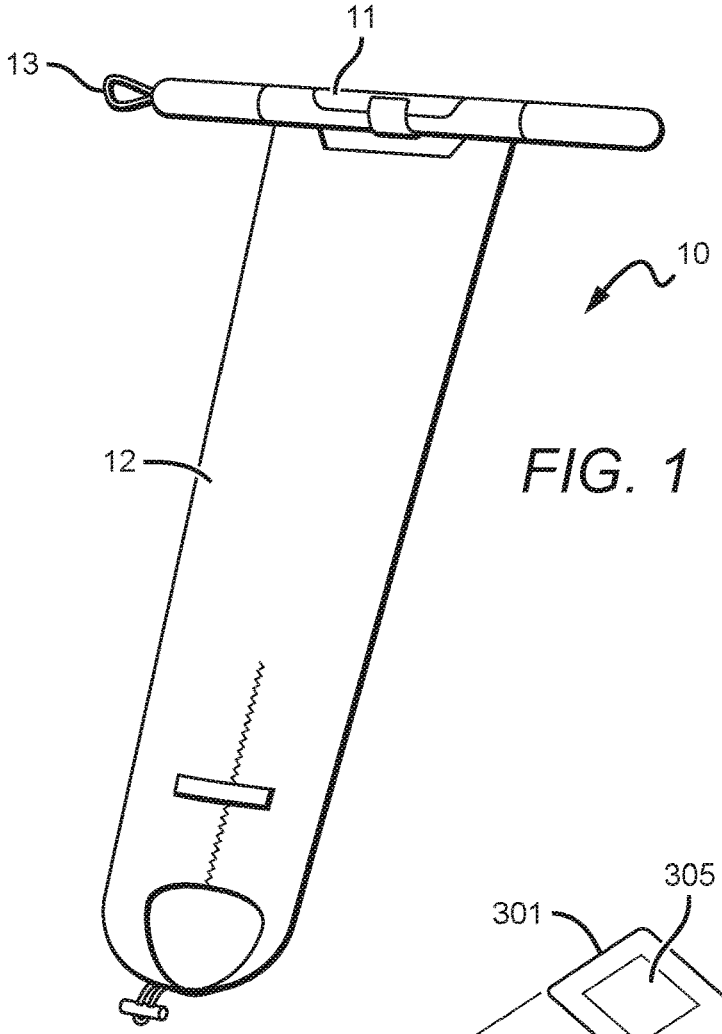
FIG. 1 is a front perspective view of a multimodal fitness bar in an unfurled configuration, in accordance with one or more implementations.

FIG. 1 shows a front perspective view of a multimodal fitness bar 10 (hereinafter multimodal fitness bar 10), in an unfurled configuration, in accordance with one or more implementations. Multimodal fitness bar 10 may include one or more of a bar assembly 11, a resistance assembly 12, and a hanging member 13.

Figure 2:
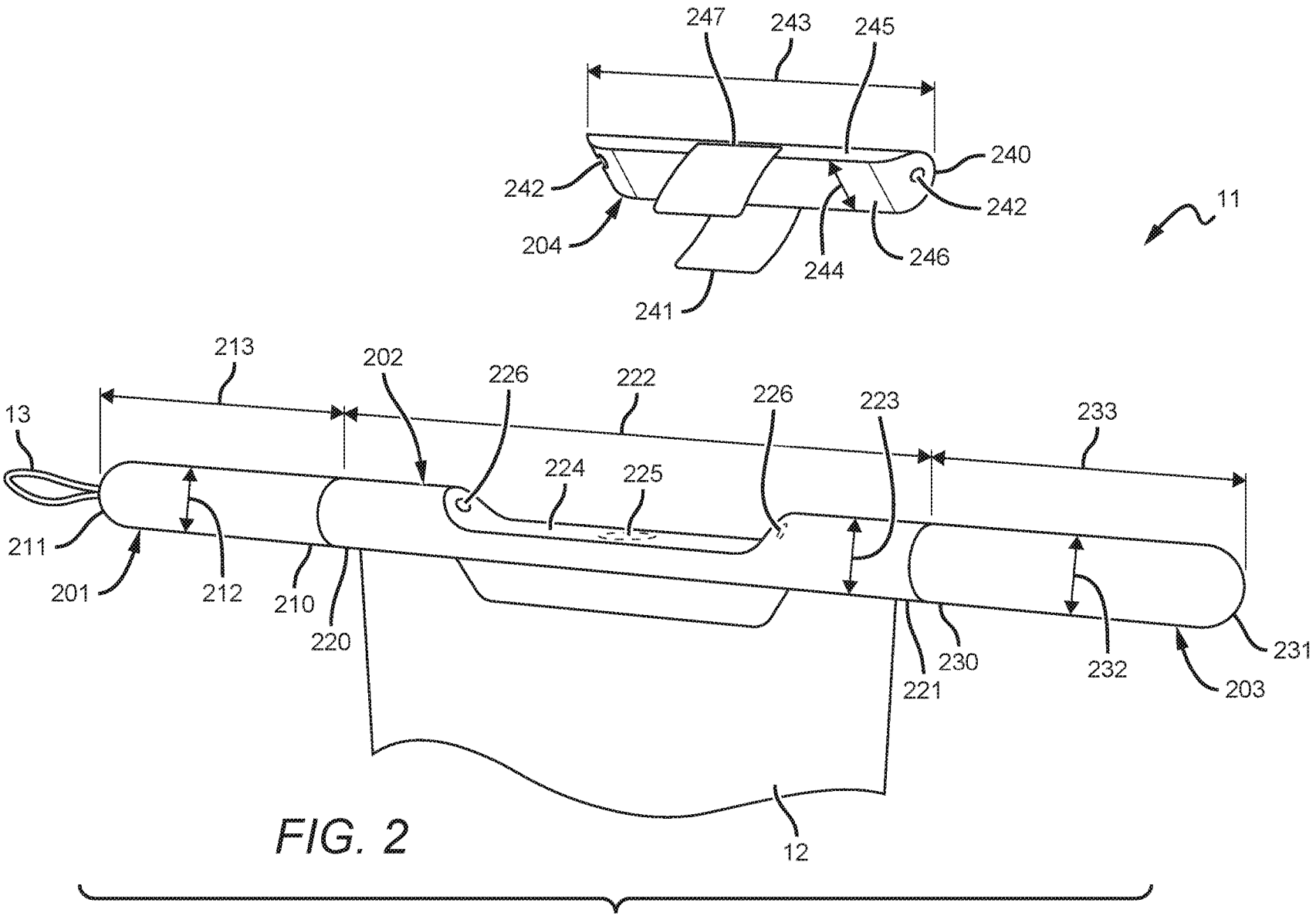
FIG. 2 is a partial, front perspective view of a multimodal fitness bar in an unfurled configuration, in accordance with one or more implementations.

FIG. 2 shows a partial, front perspective view of multimodal fitness bar 10, in an unfurled configuration, in accordance with one or more implementations. Bar assembly 11 may include one or more of a first handle 201, a bar 202, a second handle 203, and a weighting assembly 204. In some implementations, first handle 201 may be a generally cylindrical member with a proximal end 210, a distal end 211, a diameter 212, and a length 213. Proximal end 210 of first handle 201 may be attached to bar 202 and distal end 211 of first handle 201 may be attached to hanging member 13. In some implementations, length 213 of first handle 201 may be between 100 mm and 140 mm and diameter 212 of first handle 201 may be between 27 mm and 37 mm.

In some implementations, bar 202 may be a generally cylindrical member with a first end 220, a second end 221, a length 222, a diameter 223, a depression 224, a logo 225, and bar magnets 226. First end 220 of bar 202 may be attached to proximal end 210 of first handle 201. Second end 221 of bar 202 may be attached to proximal end 230 of second handle 203. In some implementations, bar 202 is constructed of aluminum. It should be appreciated that bar 202 may be constructed of various rigid, or semi-rigid materials. It should be further appreciated that bar 202 may be non-cylindrical. For example, bar 202 might be an octagonal prism, or bar 202 may have curves or kinks, or undulations, such as those known for barbells. In some implementations, length 222 of bar 202 may be between 225 mm and 275 mm and diameter 223 of bar 201 may be between 27 mm and 37 mm.

Depression 224 may be a depression in, indentation in, or carve out of the body of bar 202, with the length of depression 224 being generally parallel with the longitudinal axis of bar 202. One or more bar magnets 226 may be included at or near the surface of depression 224. For clarity, bar magnets 226 are referred to as bar magnets 226 due to their placement on or in bar 202, as opposed to due to the shape or type of magnet. It should be appreciated that bar magnets 226 may be of various sizes, shapes, and numerosity, including a single magnet such as a magnetic strip that spans the length of depression 224.

In some implementations, weighting assembly 204 may include one or more of a weight 240, a weighting strap 241, and weight magnets 242. Weight 240 may be a partially cylindrical member with a length 243, a diameter 244, a cylindrical surface 245, a planar surface 246, and a channel 247. For purposes of this specification, a partial cylinder is a shape formed when a cylinder is cut along a plane, which is perpendicular to the ends of the cylinder. Planar surface 246 may be the flat surface formed by such theoretical cut and cylindrical surface 245 may be the remaining cylindrical portion of the surface. Planar surface 246 may be curved at one or both ends, such that weight 240 may be tapered at one or both ends. Diameter 244 of weight 240 is the diameter of the theoretical cylinder from which the partially cylindrical shape is derived. In some implementations, diameter 244 of weight 240 may be 27 mm and 37 mm. In some implementations, diameter 244 of weight 240, is substantially similar to diameter 224 of bar 202 and the surface of depression 222 is substantially similar in shape to planar surface 246 of weight 240, such that when weight assembly 204 is coupled with bar 202, a substantially complete cylinder is formed. In some implementations, length 243 of weight 240 may be between 130 mm and 170 mm.

Channel 247 in weight 240 may be a cavity configured to receive weighting strap 241. For clarity, weight magnets 242 are referred to as weight magnets 242 due to their placement on or in weight 242, as opposed to due to the weight or type of said weight magnets 242. Weighting assembly 204 and bar 202 are in an uncoupled configuration in FIG. 2.

Second handle 203 may be a generally cylindrical member with a proximal end 230, distal end 231, diameter 232, and length 233. Proximal end 230 of second handle 201 may be attached to second end 221 of bar 202. In some implementations the longitudinal axis of first handle 201, second handle 203, and bar 202, are aligned such that first handle 201, second handle 203, and bar 202 form a continuous cylinder.

In some implementations, diameter 212 of first handle 201, diameter 223 of bar 202, and diameter 232 of second handle 203 may be substantially similar, such that the diameter of bar assembly 11 is consistent throughout its length, when weighting assembly 204 is in a coupled configuration. In some implementations, first handle 201 and second handle 203 are constructed from cork, to provide comfort and friction, when gripped by a user. It should be appreciated that first handle 201 and second handle 203 may be constructed from a variety of materials, which may provide more or less friction and comfort when gripped by a user. It should be further appreciated that first handle 201 and second handle 203 may be attached to bar 202 using a variety of coupling arrangements. For example, bar 202 may extend into first handle 201 and second handle 203, which may provide additional bending strength for first handle 201 and second handle 203. In some implementations, bar 202 may extent for the entire length of bar assembly 11 and first handle 201 and second handle 203 may be sleaves of rubber, fabric, or other material that surrounds the ends of bar assembly 11. In some implementations, first handle 201, second handle 203, and bar 202, may be constructed of a single material, such as aluminum, and may be an integral whole. In such implementations, gripping features may be etched on or near first handle 201 and second handle 203, to increase friction with the user's grip.

In some implementations, hanging member 13 may be a loop with two ends that terminate at and are attached to distal end 211 of first handle 201. Hanging member 13 may be constructed of flexible cord, such as paracord, and may allow multimodal fitness bar 10 to be attached to hooks, carabiners, and the like. It should be appreciated that hanging member 13 may be attached to either end of bar assembly 11, and may be another means of hanging bar assembly 11, such as a hook or tie.

Figure 3A:
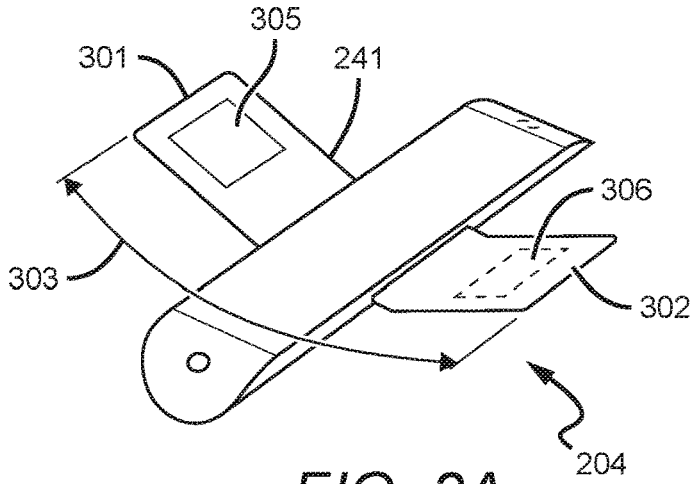
FIG. 3A is a bottom perspective view of a weighting assembly, in accordance with one or more implementations.

FIG. 3A shows a bottom perspective view of a weighting assembly 204, in accordance with one or more implementations. In some implementations, weighting strap 241 may be a sheet of material with a first end 301, a second end 302, and a length 303. First weighting coupling 304 may be attached to weighting strap 241 at or near first end 301. Second weighting coupling 305 may be attached to weighting strap 241 at or near second end 302. First weighting coupling 304 and second weighting coupling 305 may be Velcro, magnets, or other components that allow the two ends of weighting strap 241 to mechanically or magnetically couple with each other. Weighting strap 241 may also be secured with a cinching mechanism or the like. In some implementations length 303 of weighting strap 241 is sufficient to allow weighting strap 241 to pass through channel 247 and around the body of bar 202, at or near depression 222, such that first weighting coupling 304 and second weighting coupling 305 couple to secure weight 240 to bar 202.

It should be appreciated that weighting strap 241 may be replaced or supplemented with additional means of securing weighting assembly 241 to bar 202. For example, corresponding Velcro strips or magnets could be placed along planar surface 246 and depression 224. Additionally, weighting strap 241 may be two separate members affixed to cylindrical surface, as opposed to a single member which passes through channel 247. In such an implementation, channel 247 may be omitted. In some implementations, weighting strap 241 may be constructed of a fabric material similar to that of a fabric watch band, or another flexible and durable material.

Figure 3B:
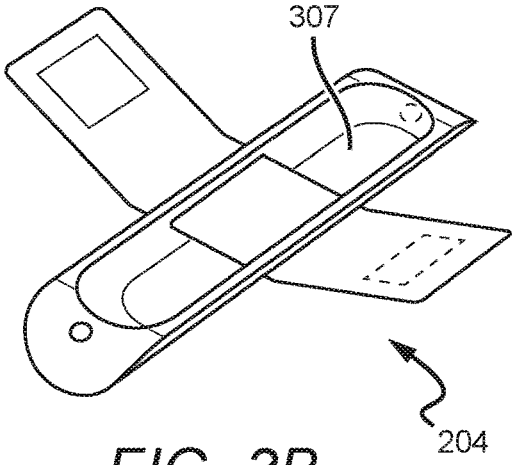
FIG. 3B is a bottom perspective view of a weighting assembly, in accordance with one or more implementations.

FIG. 3B shows a bottom perspective view of a weighting assembly 204, in accordance with one or more implementations. In this implementation, planar surface 246 is replaced by interior cylindrical surface 307. Interior cylindrical surface 307 defines a partially cylindrical cavity. Assuming that weight 240 were made of the same material implementations of weighting assembly 204 depicted in FIGS. 3A and 3B were made of the same material, the implementation depicted in FIG. 3A would weigh more than the implementation depicted in FIG. 3B. In some implementations, weight 240 may be constructed of aluminum. Weight 240 may also be constructed of heavier or lighter materials, to increase or decrease the weighting effect of weight 240. Weight 240 may weigh an amount that is considered useful or common for fitness purposes such as a 2 pounds, 5 pounds, or 1 kg.

FIG. 4A shows a partial, front perspective view of multimodal fitness bar 10 with weighting assembly 205 and bar 202 in a coupled configuration, in accordance with one or more implementations. Planar surface 246 of weight 240 is disposed against depression 224 of bar 202. First end 301 and second end 302 of strap 241 are wrapped around the body of bar 202 and first weighting couplings 304 is coupled with second weighting coupling 305, securing weight 240 to bar 202. Weight magnets 242 are aligned with and magnetically coupled with bar magnets 226, further securing weight 240 to bar 202.

FIG. 4B is a partial, front perspective view of multimodal fitness bar 10. In this alternative implementation, bar assembly 11 does not include a weighting assembly. In this implementation, bar 202 is a complete cylinder and lacks depression 224.

Figure 5A:
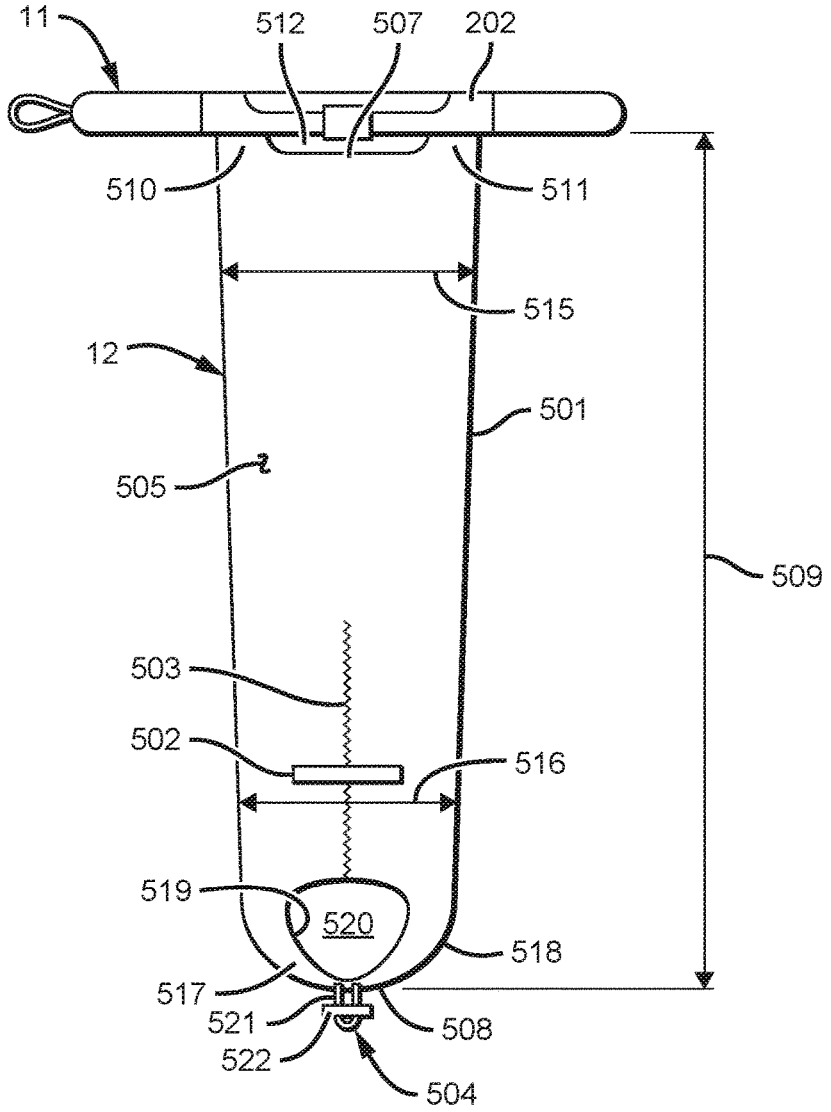
FIG. 5A is a front view of a multimodal fitness bar in an unfurled configuration, in accordance with one or more implementations.

FIG. 5A is a front view of multimodal fitness bar 10 in an unfurled configuration, in accordance with one or more implementations. Resistance assembly 12 may include one or more of sheet a 501, a front furling member 502, an alignment stitch 503, and a toggle assembly 504. In some implementations, sheet 501 is a sheet of elastomeric fabric with a front surface 505, a rear surface 506, a proximal end 507, a distal end 508, and a length 509. Proximal end 507 may be attached to bar assembly 11. In some implementations, sheet 501 may include a first bar coupling 510, a second bar coupling 511, and a cutaway 512, each disposed near proximal end 507. As used in this specification with respect to sheet 501, proximal end 507 refers to the end of sheet 501 that is disposed near and/or attached to bar assembly 11, when resistance assembly 12 is in an unfurled configuration. As used in this specification with respect to sheet 501, distal end 508 refers to the end of sheet 501 that is disposed farthest away from bar assembly 11, when resistance assembly 12 is in an unfurled configuration.

In some implementation, cutaway 512 may be disposed between first bar coupling 510 and second bar coupling 511. First bar coupling 510 and second bar coupling 511 may be attached to bar 202, securing sheet 501 to bar assembly 11. Cutaway 512 may be of sufficient width and depth to receive a user's hand in the channel defined by cutaway 512 and bar 202. In other implementations, cutaway 512 may not be present and the entire width of proximal end 507 of sheet 501 may be coupled to bar 202. First bar coupling 510 and second bar coupling 511 may be attached to bar 202 by a variety of means, including, but not limited to stitching and adhesives. It should be appreciated that sheet 501 may be attached to bar assembly 11 in a variety of manners with more or less points of coupling.

In some implementations sheet 501 may be constructed of a flexible fabric such as woven recycled polyethylene terephthalate (RPET). In some implementations, sheet 501 may have elastic qualities that may allow for variable tension during fitness activities. In other implementations, sheet 501 may not have elastic qualities. It should be appreciated that sheet 501 may be constructed of various materials, including but not limited to, woven polymers, rubbers, or traditional fabrics.

In some implementations sheet 501 may be generally tapered, with a proximal width 515 that is greater than a distal width 516. In other implementations, sheet 501 may be generally rectangular.

In some implementations, sheet 501 may include an opening 520, disposed near distal end 508. Thus, sheet 501 may form a loop 517 at distal end 508, with an exterior perimeter 518 and an interior perimeter 519, with the interior perimeter 519 defining opening 520 in sheet 501.

Opening 520 in sheet 501 may be configured to receive the foot of a user. In some implementations, a distal portion of loop 517 that is disposed closest to distal end 508 of sheet 501 may curl towards the user, such that such distal portion of loop 517 may hang in a relatively horizontal configuration, as opposed to the vertically hanging configuration of the remainder of sheet 501. Such distal portion of loop 517 of sheet 501 may allow for a greater area of interface between the bottom of the user's foot and sheet 501.

In some implementations, sheet 501 may be an integral whole. In other implementations, one or more of loop 517 of sheet 501, first bar coupling 510, and second bar coupling 511, may be non-integral members that are attached to sheet 501. Loop 517 of sheet 501 may also be configured to receive both of a user's feet simultaneously. In some implementations, length 509 of sheet 501 may be between 650 mm and 900 mm.

In some implementations, toggle assembly 504 may include one or more of a loop 521 passed through two openings in toggle 522. Loop 521 may be a cord and may be attached to sheet 501 at or near distal end 508 of sheet 501. In some implementations, toggle 522 may be disposed between 35 mm and 45 mm from the distal end 508 of sheet 501. In some implementations, toggle 522 may be between 29 mm and 39 mm in length and between b6 mm and 10 mm in diameter.

Front furling member 502 may be attached to front surface 505 of sheet 501. In some implementations, front furling member 502 may be attached above loop 517 of sheet 501. Alignment stitch 503 may be a stitching or other visual identifier disposed near loop 517 of sheet 501. Alignment stich 503 may serve as a visual que that that may assist the user to properly align the user's foot in opening 520.

Figure 5B:
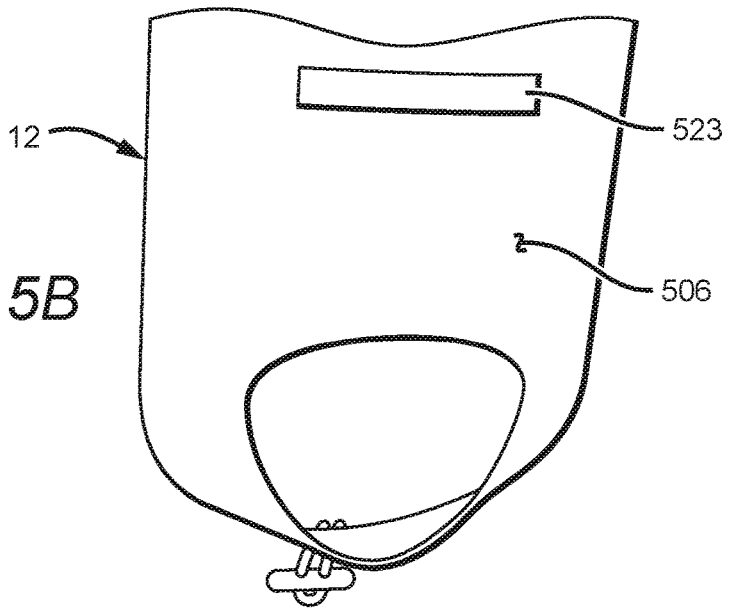
FIG. 5B is a partial rear perspective view of a sheet assembly, in accordance with one or more implementations.

FIG. 5B is a partial, rear perspective view of sheet assembly 12, in accordance with one or more implementations. Sheet assembly 12 may include one or more of rear surface 506 and rear furling member 523. In some implementations rear furling member 523 may be attached to rear surface 506 of sheet 501. It should be appreciated that rear surface 506 of sheet 501 may be substantially similar to front surface 505 of sheet 501, in most respects. Notwithstanding the foregoing, in some implementations, alignment stitch 503 may be omitted from rear surface 506, insofar as multimodal fitness bar 10 may be more suited to receiving a user's foot through front surface 505, due to the direction of the curl of loop 517 of sheet 501. Still in other implementations, alignment stitch 503 may be included on both front surface 505 and rear surface 506.

FIG. 6 shows a front view of furling member 502, in accordance with one or more implementations. Furling member 502 may include one or more of a first end 601, a second end 602, a middle portion 603, a first coupling 604, and a second coupling 605. Front furling member 502 may be generally rectangular and constructed of a flexible fabric, such as woven RPET. In some implementations, first coupling 604 of front furling member 502 and second coupling 605 of front furling member 502 may be one or more box stitches, disposed at or near first end 601, and second end 602, respectively. It should be appreciated that first coupling 604 of front furling member 502 and second coupling 605 of front furling member 502 may be one or more box stitches may be other means of attaching furling member 502 to sheet 501, including but not limited to various types of stitching or adhesive.

In some implementations first coupling 604 and second coupling 605 of front furling member 502 may be attached to front surface 505 of sheet 501, while middle portion 603 of front furling member 502 may not be attached to sheet 501, thereby defining a channel between middle portion 603 and front surface 505 of sheet 501. In some implementations, said channel is of sufficient size to receive toggle 522 in a vertical position, but not so large as to allow toggle 522 to pass therethrough in a horizontal position. In some implementations front furling member 502 may be between 78 mm and 98 mm in length and between 9 mm and 15 mm in width, with the length of said channel being between 30 mm and 42 mm.

Rear furling member 523 may be substantially similar to front furling member 502 with respect to dimensions, components, materials, method of attachment, and location of attachment, except that rear furling member may be attached to rear surface 506 of sheet 501, as opposed to front surface 505 of sheet 501.

It should be appreciated that toggle assembly 502 and furling member 502 may be replaced with various means of securing sheet 501 in a furled position. Such means may include, but not be limited to, snap closures, Velcro, hooks, ties, cinches, and the like.

FIG. 7 shows a front perspective view of multimodal fitness bar 10, in a furled configuration, in accordance with one or more implementations. Insofar as sheet 501 may be constructed of flexible material, it may be furled about bar assembly 11. Once sheet 501 is furled, toggle assembly 504 may removably couple with front furling member 502 to secure sheet 501 in a furled configuration. It should be appreciated that sheet 501 may be furled in the reverse direction and toggle assembly 504 may be coupled with rear furling member 523 to secure sheet 501.

Figure 8:
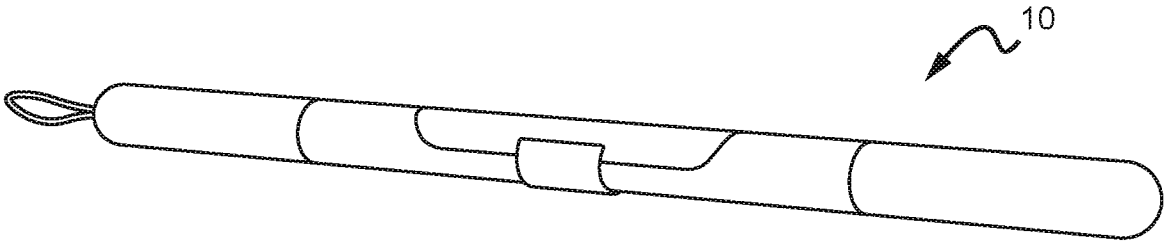
FIG. 8 is a front perspective view of a bar assembly, in accordance with one or more implementations.

FIG. 8 shows a front perspective view of a multimodal fitness bar 10, in accordance with one or more implementations. In this implementation, resistance assembly 12 is omitted. The omission of resistance assembly 12 may reduce the cost to produce multimodal fitness bar 10 and reduce the overall size of multimodal fitness bar 10, while still allowing a user to perform a subset of the exercises that may be performed with other implementations, including but not limited to certain weight training exercises. Apart from the omission of resistance assembly 12, multimodal fitness bar 10 may be substantially the same as described above.

Figure 9:
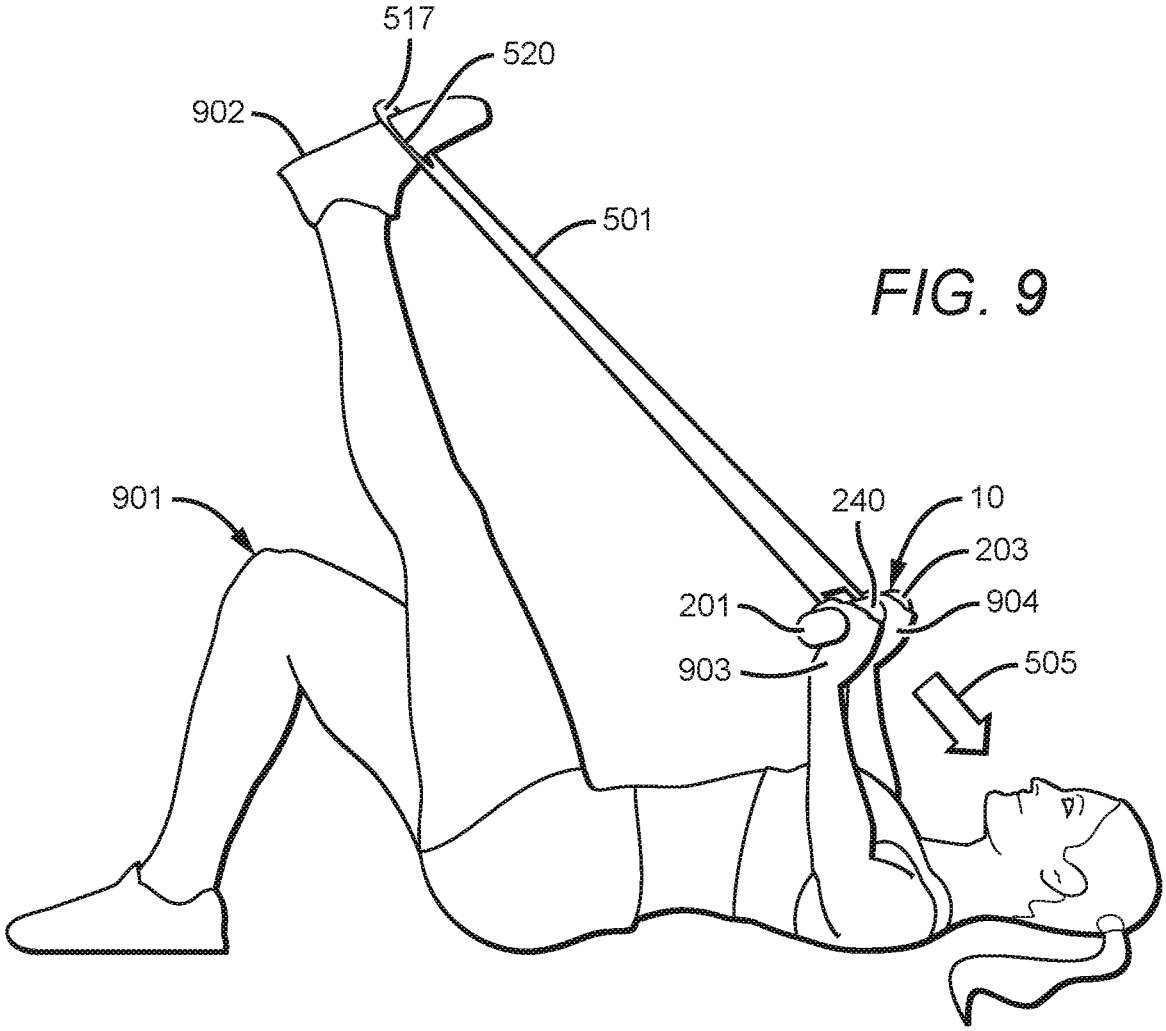
FIG. 9 is a side perspective view of a multimodal fitness bar being used by a user, in accordance with one or more implementations.

FIG. 9 shows a user 901 operating a multimodal fitness bar 10, in accordance with one or more implementations. User 901 is lying on her back with one of her feet 902 stretched above her. User's foot 902 is received through opening 520 in sheet 501 and the bottom of user's foot 902 rests on the distal portion of loop 517 of sheet 501. User's first hand 903 grips first handle 201 and user's second hand 904 grips second handle 203. User 901 applies downward force 905 with user's first hand 903 and second hand 904 to create tension in sheet 501, thereby stretching user's 901 calf and hamstring. Weight 240 creates additional downward force to stretch the user's 901 calf and hamstring. It should be appreciated that FIG. 9 demonstrates only one of many possible exercises that may be performed with multimodal fitness bar 10.

Although the present technology has been described in detail for the purpose of illustration based on what is currently considered to be the most practical and preferred implementations, it is to be understood that such detail is solely for that purpose and that the technology is not limited to the disclosed implementations that are within the spirit and scope of the appended claims. For example, it is to be understood that the present technology contemplates that, to the extent possible, one or more features of any implementation can be combined with one or more features of any other implementation.

What is claimed is:

1. A multimodal fitness bar, comprising:
- a. a bar with a depression, a first end, and a second end, wherein a first handle is attached to said first end and a second handle is attached to said second end;
  - i. wherein said first handle and said second handle are configured to be gripped by a user; and
- b. a weighting assembly removably attached to said bar;
  - i. wherein said weighting assembly includes a weight and a weighting strap configured to secure said weighting assembly to said bar; and
  - ii. wherein said weight of said weighting assembly and said depression of said bar are of complimentary shape, such that said weight of said weighting assembly and said bar form a substantially complete cylinder when said weight of said weighting assembly and said bar are in an attached configuration.

2. The multimodal fitness bar of claim 1, further comprising a hanging member.

3. The multimodal fitness bar of claim 1 wherein:
- a. said bar includes a first magnet;
- b. said weight of said weighting assembly includes a second magnet; and
- c. said first magnet and said second magnet are magnetically coupled when said weight of said weighting assembly and said bar are in said attached configuration.

4. A multimodal fitness bar, further comprising:
- a. a bar assembly and a resistance assembly;
- b. wherein the bar assembly includes:
  - i. a bar with a first end and a second end, wherein a first handle is attached to said first end and a second handle is attached to said second end;
  - ii. wherein said first handle and said second handle are configured to be gripped by a user;
- c. wherein the resistance assembly includes:
  - i. a sheet and one or more means for securing said sheet in a furled configuration, about said bar assembly;
  - ii. wherein said sheet includes:
  - iii. a proximal portion attached to said bar assembly and a distal portion with an opening configured to receive a foot of the user.

5. A multimodal fitness bar, comprising:
- a. a bar assembly and a resistance assembly;
- b. wherein the bar assembly includes:
  - i. a bar with a first end and a second end, wherein a first handle is attached to said first end and a second handle is attached to said second end;
  - ii. wherein said first handle and said second handle are configured to be gripped by a user; and
  - iii. a weighting assembly removably attached to said bar;
    - 1. wherein said weighting assembly includes a weight and a weighting strap configured to secure said weighting assembly to said bar;
- c. wherein the resistance assembly includes:

i. a sheet and one or more means for securing said sheet in a furled configuration about said bar assembly;

ii. wherein said sheet includes:

1. a proximal portion attached to said bar assembly and a distal portion with an opening configured to receive a foot of the user.

6. The multimodal fitness bar of claim 1, wherein said sheet further comprises:

a. a generally trapezoidal middle portion, disposed between said proximal portion of said sheet and said distal portion of said sheet.

7. The multimodal fitness bar of claim 1, wherein:

a. said bar is generally cylindrical and includes a depression;

b. said weight is partially cylindrical and includes a planar surface with a length approximately equal to a length of said depression;

i. wherein, said weight and said bar are configured to form a substantially complete cylinder when said weighting assembly is coupled with said bar.

8. The multimodal fitness bar of claim 7, further comprising a first magnet affixed to said bar and configured to removably couple with a second magnet affixed to said weight.

9. The multimodal fitness bar of claim 7, wherein said weight further comprises a channel configured to receive said weighting strap therethrough;

a. wherein said weighting strap further comprises a first end with a first coupling means and a second end with a second coupling means;

i. wherein said first coupling means of said weighting strap and said second coupling means of said weighting strap are configured to removably couple with each other and to secure said weight to said bar.

10. The multimodal fitness bar of claim 1, further comprising a hanging member.

11. The multimodal fitness bar of claim 1, wherein:

a. said one or more means for securing said sheet in a furled configuration about said bar assembly comprises a toggle assembly and a furling member;

b. wherein said toggle assembly is attached to said distal end of said sheet and comprises a toggle and a loop;

c. wherein said furling member includes a first end, a second end, and a middle portion;

i. wherein said first end of said furling member is attached to said sheet, said second end of said furling member is attached to said sheet, and said middle portion of said furling member is not attached to said sheet; and ii. wherein said middle portion of said furling member and said sheet define a cavity configured to receive said toggle.

12. The multimodal fitness bar of claim 9, wherein:

a. said one or more means for securing said sheet in a furled configuration about said bar assembly comprises a toggle assembly and a furling member;

b. wherein said toggle assembly is attached to said distal end of said sheet and comprises a toggle and a loop;

c. wherein said furling member includes a first end, a second end, and a middle portion;

i. wherein said first end of said furling member is attached to said sheet, said second end of said furling member is attached to of said sheet, and said middle portion of said furling member is not attached to said sheet; and ii. wherein said middle portion of said furling member and said sheet define a cavity configured to receive said toggle.

13. The multimodal fitness bar of claim 12, further comprising a first magnet affixed to said bar and configured to removably couple with a second magnet affixed to said weight.

14. The multimodal fitness bar of claim 12, wherein said first handle and said second handle each have a length between 100 mm and 140 mm and wherein said first handle and said second handle each have a diameter between 27 mm and 37 mm.

15. The multimodal fitness bar of claim 12, wherein said bar has a length between 225 mm and 275 mm and wherein said bar has a diameter between 27 mm and 37 mm.

16. The multimodal fitness bar of claim 12, wherein each of said first handle has a diameter that is substantially the same as a diameter of said second handle, and wherein said bar has a diameter that is substantially the same as said diameter of said second handle.

17. The multimodal fitness bar of claim 12, wherein said weight has a length between 130 mm and 170 mm.

18. The multimodal fitness bar of claim 12, further comprising one or more alignment stitches disposed on said sheet.

* * * * *